United States Patent [19]

Schneider

[11] Patent Number: 4,704,947

[45] Date of Patent: Nov. 10, 1987

[54] BIDIRECTIONAL FLUID FLOW VALVE

[75] Inventor: Robert H. Schneider, Beaver Dam, Wis.

[73] Assignee: Versa Technologies, Inc., Racine, Wis.

[21] Appl. No.: 789,518

[22] Filed: Oct. 21, 1985

[51] Int. Cl.[4] ..... F15B 15/22

[52] U.S. Cl. ..... 91/518; 91/443; 91/534; 137/513.3; 137/517

[58] Field of Search ..... 91/443, 515, 518, 534; 137/513.3, 504, 517

[56] References Cited

U.S. PATENT DOCUMENTS

| | | | |
|---|---|---|---|
| 911,005 | 1/1909 | Garman | 137/504 |
| 2,179,144 | 11/1939 | Buttner | 137/517 |
| 2,450,446 | 10/1948 | Rupp | 137/513.3 X |
| 3,367,187 | 2/1968 | Smith | 137/517 X |
| 3,741,241 | 6/1973 | Jackson | 137/504 |
| 4,355,565 | 10/1982 | Bianchetta | 91/518 |

*Primary Examiner*—Robert G. Nilson

[57] ABSTRACT

A valve for regulating the bidirectional flow of hydraulic fluid in an hydraulic fluid line, wherein the flow resistance in one direction can be increased, includes a hollow body (10) with an internal seat (20), a spool member (22) slidably mounted within the body (10), the spool (22) having a cylinder portion (24) and a nozzle portion (26) containing orifices (30, 32, 34), bias means (40), and limit means (42). The spool (22) is slidable within the body (10) between a position in which fluid flows through all orifices (30, 32, 34) to provide unrestricted fluid flow when fluid flows through the valve in one direction, and a position in which the nozzle (26) engages the seat (20) to block fluid flow through some of the orifices (30, 32, 34) and thereby increase flow resistance when fluid flows through the valve in the opposite direction. Bias means (40) acts to bias the spool (22) to the position in which fluid flow is unrestricted, and the limit means (42) limits the movement of the spool (22) within the body (10).

6 Claims, 4 Drawing Figures

BIDIRECTIONAL FLUID FLOW VALVE

The invention disclosed relates to valves used to require the flow of fluid in hydraulic fluid lines and more particularly to a bidirectional flow valve in which the fluid flow resistance in one direction can be increased. The valve is particularly useful in retracting two or more unequally loaded hydraulic cylinders.

Hydraulic cylinders are often used to raise and lower a trailer or vehicle at rest, allowing unloading at dock level, permitting a tractor to be engaged or disengaged from a trailer, and the like. Hydraulic cylinders are also used as load stabilizers and tilting devices. The hydraulic cylinders are connected in line with integral lock valves or pilot operated check valves, that maintain the cylinder in its extended position when the cylinder is loaded.

Problems are frequently encountered when retracting a plurality of cylinders form their extended position with a single control device when the cylinders are unequally loaded. When the flow of hydraulic fluid is supplied from the single control device to the rod ends of the cylinders to retract the cylinders, the pilot operated check valve associated with the cylinder having the lowest pressure (i.e. the cylinder carrying the least amount of load) will unseat first, and the cylinder will commence to retract. The first-retracting cylinder may consume all the flow of hydraulic fluid available to the circuit. As a result, no fluid is available to exert pressure on the remaining unseated check valves through the associated pilot lines. Consequently, the more heavily loaded cylinders are prevented from retracting. The vehicle or trailer thus leans to the side of the first-retracting cylinder, with the potential for damage to the cargo or vehicle, and injury to the operator.

Previous attempts to overcome the above-described problems have included the use of pressure-compensated flow control valves, as well as orifice check valves. Pressure-compensated flow control valves perform relatively satisfactorily, but are sensitive to contamination and resulting malfunction. Orifice check valves also function satisfactorily, but exhibit very slow retraction rates when the overrunning load is removed, since hydraulic fluid is forced through the orifice of the check valve at all times during cylinder retraction, even when the overrunning load is removed.

A need thus exists for a device that insures that hydraulic cylinders operated by a single control valve retract relatively simultaneously, that allows increased rates of retraction when the overrunning load is removed and that is relatively insensitive to contamination.

It is therefore the object of the present invention to provide an improved fluid flow control valve that meets the above need. The valve insures that a plurality of hydraulic cylinders controlled by a single control valve will retract relatively simultaneously, and allows increased rates of extension and retraction of a plurality of hydraulic cylinders when load on the cylinders is relieved. The valve is of simple design and thereby relatively insensitive to contamination.

Briefly, the present invention contemplates a valve for regulating the flow of hydraulic fluid from an hydraulic cylinder. One such valve may be connected in series with each of a plurality of hydraulic cylinders, which in turn are connected in parallel to a single control valve.

The valve of the present invention includes a hollow body having an internal seat. The body is provided with a spool member having a cylinder portion and a nozzle portion. The nozzle portion is provided with one or more orifices in its end and one or more orifices in its wall. The spool is slidable within the body between a position in which fluid flows through all available orifices and flow is generally unrestricted, and a position in which the nozzle engages the internal seat to block fluid flow through the nozzle tip orifices. Fluid flow is then restricted. A bias element is provided to bias the spool member to the position in which fluid flow is unrestricted. A means for limiting the axial movement of the spool is provided inside the hollow body.

When extending the hydraulic cylinders, hydraulic fluid flows through the valve so as to force the spool into its position in which fluid flow is unrestricted. In this manner, the cylinders may be extended rapidly.

When retracting the hydraulic cylinders, fluid flow through the circuit is reversed. With, for example, a pair of unequally loaded cylinders, the check valve of the least-loaded cylinder will unseat first. The least-loaded cylinder will commence to retract, causing a surge of hydraulic fluid through the line leading from that cylinder. The surge of fluid forces the valve of the present invention in series with that cylinder into its flow restriction position reducing fluid flow in the line. The flow restriction in the valve is such that the remaining available flow in the circuit is sufficient to unseat the pilot operated check valve in line with the remaining cylinder and commence retraction of that cylinder. The retraction of the latter cylinder causes another surge of fluid, which forces the valve of the present invention in series with that cylinder into its flow restricting position. In this manner, the cylinders retract relatively simultaneously during retraction under load. When the load is relieved, e.g. when the wheels of the trailer being lowered touch the ground, the biasing element acts to overcome the pressure exerted on the spools, and biases the valves to the position in which fluid flows through all orifices and flow is unrestricted. Thereafter, the cylinders may retract rapidly.

The drawings illustrate the best mode presently contemplated for carrying out the invention.

Figure 1:
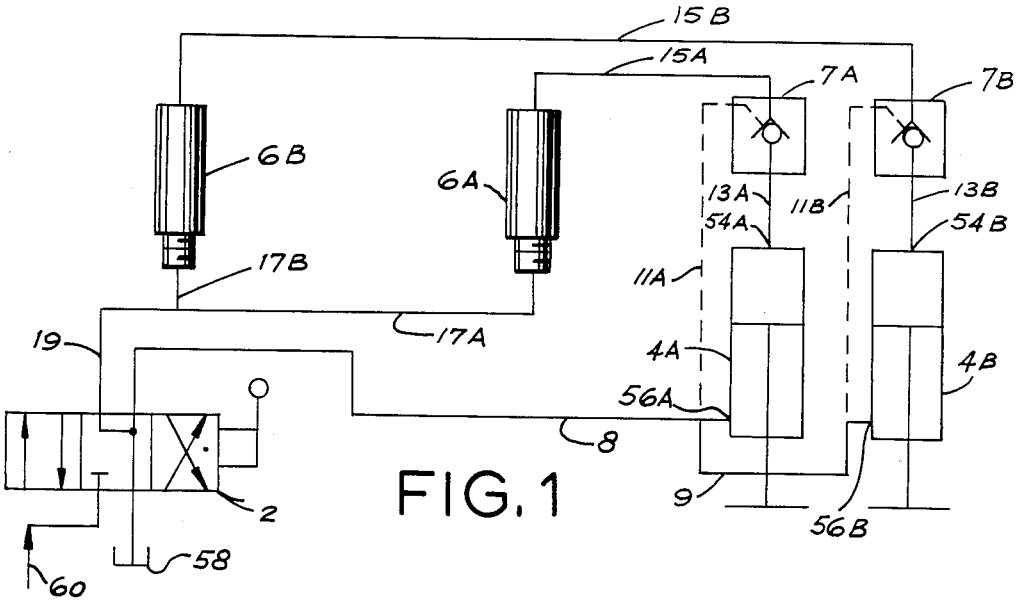
FIG. 1 is a schematic diagram showing an hydraulic circuit utilizing the valve of the present invention.

FIG. 1 schematically illustrates an exemplary hydraulic circuit in which the valve of the present invention is useful. A single four-way three-position valve 2 is the device used to control the circuits. Hydraulic cylinders 4A and 4B are connected in parallel with control valve 2 by connection of rod ends 56A and 56B of hydraulic cylinders 4A and 4B to hydraulic fluid lines 8 and 9. Hydraulic fluid lines 13A and 13B connect cylinder ends 54A and 54B of cylinders 4A and 4B to pilot operated check valves 7A and 7B. Pilot lines 11A and 11B connect lines 8 and 9 to pilot operated check valves 7A and 7B. Pilot lines 11A and 11B serve to unseat check valves 7A and 7B when it is desired to retract cylinders 4A and 4B. Hydraulic fluid lines 15A and 15B connect check valves 7A and 7B with valves 6A and 6B of the present invention. Hydraulic fluid lines 17A and 17B connect valves 6A and 6B to hydraulic fluid line 19, which closes the circuit by its connection to control valve 2. Hydraulic cylinders 4A and 4B may be used as elevation controls for raising and lowering a load, e.g. a semi-trailer or a vehicle.

Figure 2:
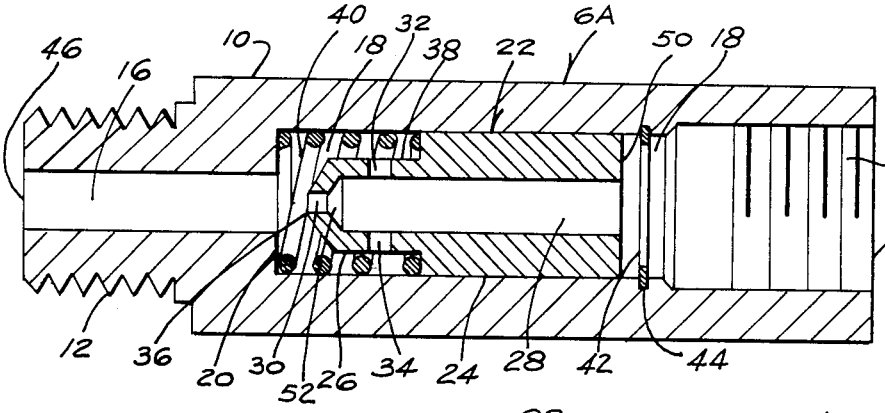
FIG. 2 is a longitudinal cross-section view of a valve constructed according to the invention.

FIG. 2 illustrates, in detail, valve 6A of the present invention. Valves 6A and 6B may be of identical construction. Valve 6A has hollow elongated body member 10 with means for connection to hydraulic fluid lines 15A and 17A. The connection means may consist of male threaded portion 12 and female threaded portion 14 at the ends of the body. The connection means serve to couple the valve to the lines.

Body 10 is provided with passages 16 and 18, which extend axially along body 10. Passages 16 and 18 are axially adjacent. Passage 18 has a dimension normal to the axis of body member 10 greater than that of passage 16, thus forming a seat 20 inside body member 10.

Figure 3:
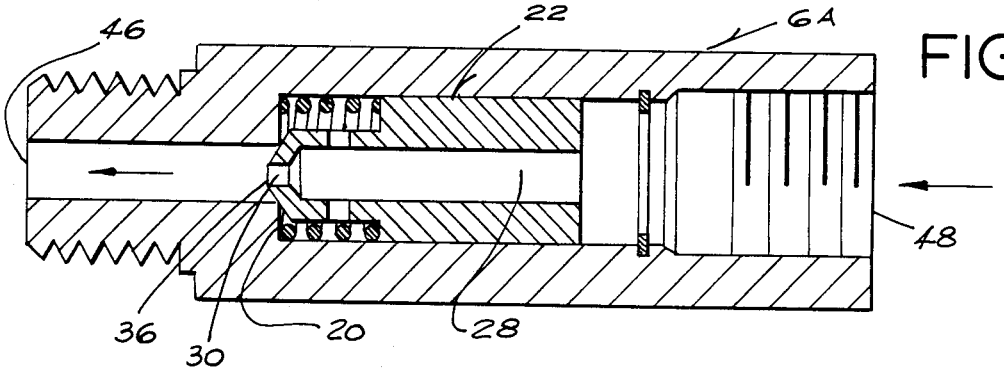
FIG. 3 is a view similar to FIG. 2, showing the valve in its flow restricting position. The valve assumes this position when fluid flow is from right to left, i.e. when the cylinders are being retracted under loaded conditions.

Spool 22 is slidably mounted inside passage 18 of body 10. Spool 22 is movable between a right hand position shown in FIGS. 2 and 4, in which the valve is generally unrestrictive to fluid flow, and a left hand position shown in FIG. 3, in which the valve restricts fluid flow. Spool 22 has a cylinder portion 24 and a nozzle portion 26. Nozzle 26 has an outside dimension normal to the axis of the valve less than that of cylinder 24, but greater than the inside dimension of passage 16. Nozzle 26 is further provided with orifices 30, 32, and 34. In the preferred embodiment shown, nozzle 26 has one orifice in its end 36 and one or more orifices in its wall 18.

Spool 22 is further provided with an internal passageway 28 which extends through cylinder 24 and into nozzle 26 to communicate with passages 16 and 18.

Bias element 40, shown in FIG. 2 as a spring, is provided between cylinder 24 of spool 22 and seat 20 of body 10. The spring 40 has an inside dimension sufficient to allow nozzle 26 to be inserted therein. Spring 40 has an outside dimension sufficient to allow it to be inserted within passage 18. Spring 40 resists movement of spool 22 to the left hand, or flow restricting, position shown in FIG. 3.

Movement limiting means 42 is provided in passage 18 of body 10. Limiting means 42 may comprise a snap ring, engaged in a circumferential slot 44 provided in passage 18. Snap ring 42 functions to retain spool 22 and spring 40 within body 10 during shipping and storage. Snap ring 42 is preferably located to allow a small amount of axial movement of spool 22 when spring 40 is fully extended. FIG. 2 shows the position of spool 22 with spring 40 fully extended and FIG. 4 shows the position of spool 22 when moved the additional amount into abutment with snap ring 42.

To assemble the valve of the present invention, spring 40 is inserted into passage 18 of body 10. Spool 22 is then inserted into passage 18, with nozzle 26 inserted inside spring 40. Snap ring 42 is engaged into circumferential slot 44, securing spool member 22 and spring 40 inside passage 18.

In operation, the operator manipulates single control valve 2 to extend or retract the hydraulic cylinders 4A and 4B. When it is desired to extend the cylinders, control valve 2 is moved to the right, as shown in FIG. 1. Hydraulic fluid flow is directed from hydraulic fluid source 60 through line 19 into lines 17A and 17B, and into valves 6A and 6B. Flow exists valves 6A and 6B into lines 15A and 15B, passes through pilot operated check valves 7A and 7B and into hydraulic cylinders 4A and 4B through lines 13A and 13B. Flow enters cylinders 4A and 4B at cylinder ends 54A and 54B to extend the rods of the cylinders. Fluid is removed from the rod ends 56A and 56B of cylinders 4A and 4B in lines 8 and 9, passing through valve 2 to sump 58.

Figure 4:
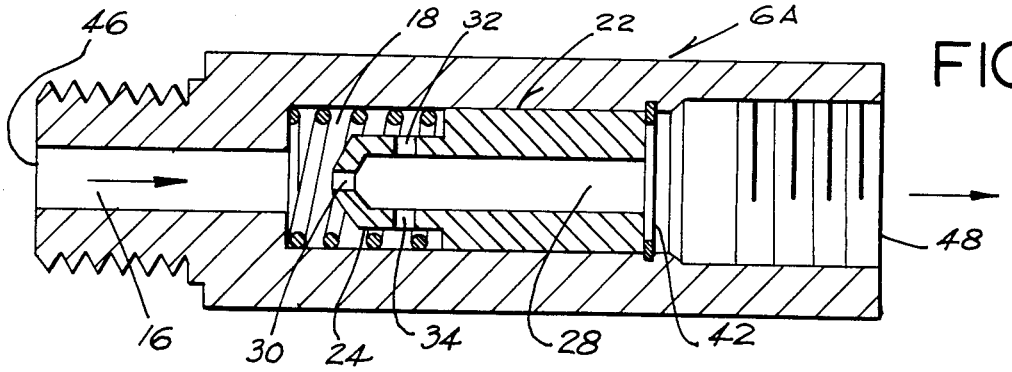
FIG. 4 is a view similar to FIG. 2, showing the valve in its position in which fluid flows through all available orifices and flow is unrestricted. The valve assumes this position when fluid flow is from left to right, i.e. when the cylinders are being extended.

The operation of valve 6A when the cylinders are being extended is shown in FIG. 4. Fluid enters the valve at opening 46 in the direction of the arrow. Fluid passes through passage 16 and into passage 18. The pressure exerted by fluid flow on spool 22 forces spool 22 to slide axially to the right within passage 18 into an abutting relationship with snap ring 42. Fluid flows from passage 18 through orifices 30, 32, and 34 into passageway 28 of spool 22, and exits valve 6A at opening 48, continuing through line 15A to hydraulic cylinder 4A.

When hydraulic cylinders 4A and 4B are being extended, the flow of hydraulic fluid passes through valves 6A and 6B in a relatively unobstructed, unrestricted manner due to the utilization of all available orifices in nozzle 26 of spool 22. Little or no alteration in the rate of extension of the cylinders thus occurs.

Once cylinders 4A and 4B are extended, pilot operated check valves 7A and 7B operate to prevent the reversal of fluid flow in the lines 13A and 13B, thereby locking cylinders 4A and 4B in their extended position.

To retract the hydraulic cylinders 4A and 4B, the operator moves control valve 2, shown in FIG. 1, to the left. This directs flow of hydraulic fluid to the rod ends 56A and 56B of hydraulic cylinders 4A and 4B through lines 8 and 9. The flow thus directed causes pressure to be exerted on pilot operated check valves 7A and 7B via pilot lines 11A and 11B. The check valve with the lowest pressure (i.e. the check valve in line with the cylinder carrying the lightest load) will unseat first. The unseating of this check valve, for example check valve 7A, causes cylinder 4A to commence to retract, and induces a surge of fluid flow through check valve 7A, into valve 6A via line 15A.

The surge of fluid flow enters valve 6A at opening 48, passing into passage 18. The flow exerts pressure on end surface 50 of spool 22, and on end surface 52 of passageway 28, causing spool 22 to slide axially to the left within passage 18 into an abutting relationship with spring 40, as shown in FIG. 2.

Valve 6A retains the position just described for a very short duration, as the pressure exerted on end surfaces 50 and 52 quickly acts to overcome the biasing force of spring 40 and causes spool 22 to further slide axially to the left within passage 18 and engage end 36 of nozzle 26 with seat 20 of body 10. Valve 6A is shown in this flow restricting position in FIG. 3. In the flow restricting position, fluid exits passageway 28 only at orifice 30, which is designed to pass only a certain percentage of the flow that can pass when spool 22 is in the position in which fluid flows through all available orifices and flow is unrestricted. The fluid flow resistance through valve 6A is thus increased.

The percentage of the flow available to the circuit passing through valve 6A in its flow restricting position is governed by the size of orifice 30. Orifice 30, in turn, is designed according to the number of hydraulic cylinders in the circuit and the distribution of load on the cylinders. The percentage of the flow available to the circuit passing through valve 6A in its flow restricting position is less than the lowest percentage of the common cylinder load carried by either cylinder 4A or cylinder 4B. For example, in a circuit containing two cylinders, one carrying 55% of the common load on the cylinders and the other carrying 45%, orifice 30 is designed to allow less than 45% of the flow available to the circuit to pass therethrough.

After valve 6A has moved into its flow restricting position, the remainder of the fluid flow available to the circuit not passing through valve 6A and cylinder 4A, over 55% in the example, is thus directed through line 9 toward cylinder 4B. This fluid flow exerts pressure on pilot operated check valve 7B through pilot line 11B. As the percentage of flow available to the circuit acting to unseat check valve 7B through pilot line 11B, over 55% in the example, is greater than the percentage of load carried by cylinder 4B, 55%, the pressure exerted by fluid in pilot line 11B is sufficient to unseat check valve 7B. Once check valve 7B is unseated, cylinder 4B will commence to retract. The surge of fluid caused by the retraction of cylinder 4B flows through line 15B into valve 6B, forcing valve 6B into its flow restricting position in the same manner as the operation of valve 6A described above. Due to the design of orifice 30 of valves 6A and 6B, less than the total amount of flow available to the circuit is allowed to pass through valves 6A and 6B when both valves are in their flow restricting positions, since each valve passes less than 45% of such flow. Thus, during loaded retraction, the valves 6A and 6B will remain in their flow restricting positions. Hydraulic cylinders 4A and 4B retract relatively simultaneously during loaded retraction.

When load on the cylinders 4A and 4B is relieved, e.g. when the wheels of the trailer touch the road or ground, the fluid pressure on end surfaces 50 and 52 of spool 22 is relieved. The biasing force of spring 40 is then sufficient to overcome the remaining pressure exerted by fluid passing through valves 6A and 6B when the load is absent, and spool 22 is thus biased from its flow restricting position of FIG. 3 to its position in which fluid flows through all available orifices and flow is generally unrestricted, shown in FIG. 2. At this point, fluid flow is allowed to exit passageway 28 through all three orifices 30, 32 and 34, and passes through passage 16. The remaining cylinder retraction may thus be accomplished at a more rapid rate than during loaded retraction, thereby decreasing substantially the amount of time required to fully retract the cylinders.

In practice, to permit the widespread use of the valve of this invention, orifice 30 will be sized for each particular application according to the number of cylinders and the relative worst-case distribution of load among the cylinders. For example, two cylinders may be used to control the elevation of a semi-trailer, and it is determined that either cylinder will always carry at least 40% of the common load on the cylinders. Orifice 30 is then designed to permit less than 40% of the flow available to the circuit to pass through the valve in its flow restricting position. In this manner the valve may be used in all similar applications, eliminating case-by-case design.

The operation above describes the use of this invention in connection with two hydraulic cylinders. It is obvious that with alteration of orifice sizes and bias forces of the spring element, this invention may be utilized with any number of hydraulic cylinders.

I claim:

1. A fluid flow control valve suitable for insertion in a line in which the fluid flow is reversible and having increasible flow resistance in one direction, said valve comprising:

a body member (10) couplable to the line for inserting the valve therein, said body member having first and second passages (16, 18) forming a flow path through the body generally along an axis thereof, said passages being contiguous and generally aligned along said axis, said first passage (16) having a smaller dimension normal to said axis than said second passage (18) for forming a valve seat (20);

a spool member (22) mounted in said second passage for reciprocal movement toward said valve seat by pressure applied to said spool member from fluid flow in one direction along the flow path and away from said valve seat by pressure applied to said spool member from fluid flow in the opposite direction along the flow path, said spool member having a tubular body portion (24) mating with said second passage, said spool member having a nozzle portion (26) of smaller dimension normal to said axis than said tubular body portion, said nozzle portion being sealingly abuttable with said valve seat when said spool member is moved toward said valve seat for sealing said first passage from said second passage, said nozzle portion of said spool member having a first orifice (30) communicating said first passage to the interior of said tubular body portion when said nozzle portion is sealingly abutted with said valve seat, and communicating said second passage to the interior of said tubular body portion when said nozzle portion is moved away from said valve seat, said first orifice having a dimension such as to increase flow resistance through said valve when said nozzle portion abuts said valve seat, said nozzle portion of said spool member having at least a second orifice (32, 34), communicating said second passage to the interior of said tubular body portion for providing an additional flow path when said spool member is moved out of abutment with said valve seat for reducing the flow resistance in said valve;

bias means (40) for resisting movement of said spool member toward said valve seat by the pressure applied to said spool member by fluid flow in said one direction; and limit means (42) for limiting the movement of said spool member away from said valve seat;

wherein said line passes fluid in said one direction from a first fluid operated cylinder when said cylinder is operated to relieve the load thereon, said line being connected in parallel with a line passing fluid from a second fluid operated cylinder, said first and second fluid operated cylinders each sharing a percentage of a common load, and wherein said first orifice is sized such that the percentage of the fluid flow available to said cylinders passing through said first orifice when said nozzle portion is sealingly abutted with said valve seat is less than the percentage of the common load carried by either said first or said second fluid operated cylinder.

2. A fluid flow control valve suitable for insertion in a line in which fluid flows in both directions and having increasible flow resistance in one direction, said valve comprising:

a body member (10) having ends (12, 14) for coupling the valve to the line, said body member having first and second cylindrical passages (16, 18) forming an axial flow path through said body, said first passage (16) having a smaller diameter normal to said axis than said second passage (18), forming a valve seat (20);

a spool member (22) mounted in said second passage for reciprocal movement toward said valve seat by pressure applied to said spool member from fluid flow in one direction along said flow path and away from said valve seat by pressure applied to said spool member from fluid flow in the opposite direction along the flow path, said spool member having a cylinder portion (24) mating with said second passage, said spool member having a nozzle portion (26) of smaller diameter normal to said axis than said cylinder portion, said nozzle portion having an end portion (36) and a wall portion (38), said end portion being sealingly abuttable with said valve seat when said spool member is moved toward said valve seat for sealing said first passage from said second passage, said nozzle portion having a first orifice (30) in said end portion communicating said first passage to the interior of said cylinder portion when said nozzle portion is sealingly abutted with said valve seat, and communicating said second passage to the interior of said cylinder portion when said nozzle portion is moved away from said valve seat, said orifice having a dimension such as to increase flow resistance through said valve when said nozzle portion abuts said valve seat, said nozzle portion having at least a second orifice (32, 34) in said wall of said nozzle, communicating said second passage to the interior of said cylinder portion for forming an additional flow path when said spool member is moved out of abutment with said valve seat for providing substantially unrestricted fluid flow through said valve;

a spring (40) for resisting movement of said spool member toward said valve seat by pressure applied to said spool member by fluid flow in said one direction, said spring abutting said valve seat and said cylinder portion of said spool member; and a snap ring (42) engaged within said second passage of said body member for limiting the movement of said spool member away from said valve seat;

wherein said line passes fluid in said one direction from a first fluid operated cylinder when said cylinder is operated to relieve the load thereon, said line being connected in parallel with a line passing fluid from a second fluid operated cylinder, said fluid operated cylinders each sharing a percentage of a common load, and wherein said first orifice is sized such that the percentage of the fluid flow available to said cylinders passing through said first orifice when said nozzle portion is sealingly abutted with said valve seats less than the percentage of the common load carried by either said first or said second fluid operated cylinder.

3. An hydraulic circuit for relatively simultaneously extending and retracting a plurality of unevenly loaded hydraulic cylinders comprising:

an hydraulic fluid source and an hydraulic fluid sump;

at least one hydraulic fluid control device connected by hydraulic fluid lines to said source and said sump;

at least first and second fluid operated hydraulic cylinders connected by hydraulic fluid lines in parallel with said control device;

a pilot operated check valve connected in series with each of said hydraulic cylinders;

at least first and second fluid flow control valves having increasible flow resistance in one direction, each valve connected by an hydraulic fluid line in series with one of said pilot operated check valves, wherein each fluid flow control valve comprises a body member having first and second passages forming a flow path through the body generally along an axis thereof, said passages being contiguous and generally aligned along said axis, said first passage having a smaller dimension normal to said axis than said second passage for forming a valve seat; further comprising a spool member slidably mounted in said second passage, said spool member having a tubular body portion mating with said second passage and a nozzle portion of smaller dimension normal to said axis than said tubular body portion, said nozzle portion having an end portion and a wall portion, said end portion being sealingly abuttable with said valve seat and having an orifice therein to increase flow resistance when said end portion abuts said valve seat, said wall portion of said nozzle portion having an orifice therein to reduce increased flow resistance when said end portion is out of abutment with said valve seat; further comprising a bias means for resisting movement of said spool member toward said valve seat; further comprising a limit means for limiting the movement of said spool member away from said valve seat; and hydraulic fluid lines connecting said first and second fluid flow control valves in parallel with said control device.

4. The hydraulic circuit of claim 3 wherein fluid passes through said flow control valves in said one direction from said fluid operated hydraulic cylinders when said cylinders are operated to relieve the load thereon, said fluid operated hydraulic cylinders each sharing a percentage of a common load, and wherein said first orifice is sized such that the percentage of the fluid flow available to said circuit passing through said first orifice when said nozzle portion is sealingly abutted with said valve seat is less than the percentage of the common load carried by either said first or said second fluid operated hydraulic cylinder.

5. The hydraulic circuit of claim 3 wherein said first and second hydraulic cylinders are unevenly loaded, and wherein said cylinders are extended by directing hydraulic fluid to said cylinders in the direction opposite to said one direction, so that fluid passes through said flow control valves through all said orifices in said nozzle portion sof said spool members without increased flow ressitance, to thereby provide relatively rapid extension of said cylinders.

6. The hydraulic circuit of claim 3 wherein said first and second hydraulic cylinders are unevenly loaed, and wherein said cylinders are retracted under loaded conditions by directing hydraulic fluid to said cylinders in said one direction so that fluid is directed toward said pilot operated check valves, and so that said check valve connected to the cylinder carrying the lesser amount of load is caused to unseat due to pressure exerted by said fluid, thereby causing said lesser-loaded cylinder to retract and to introduce fluid pressure onto said spool member of said fluid flow control valve connected in line with said lesser-loaded cylinder, said pressure forcing said nozzle portion of said spool member into sealing abutment with said valve seat to thereby increase fluid flow resistance through said flow control valve, said increase in flow resistance thus causing the remainder of said fluid flow to be directed toward said pilot operated check valve connected to said hydraulic cylinder carrying the greater amount of load, said remainder of said fluid flow exerting pressure sufficient to unseat said check valve thereby causing said greater-loaded cylinder to retract and to introduce fluid pressure on said spool member of said fluid flow control valve connected in line with said greater-loaded cylinder, said pressure forcing said nozzle portion of said spool member into sealing abutment with said valve seat to thereby increase flow resistance through said flow control valve, whereby simultaneous flow-restricted retraction of said cylinders is provided until the load on said cylinders is relieved, at which time said bias means acts to move said nozzle portions of said spool members out of sealing abutment with said valve seats, so that fluid passes through said flow control valves through all said orifices in said nozzle portion of said spool members without increased flow resistance to provide relatively rapid retraction of said cylinders after the load thereon has been relieved.

* * * * *

UNITED STATES PATENT AND TRADEMARK OFFICE

CERTIFICATE OF CORRECTION

PATENT NO. : 4,704,947

DATED : 11-10-87

INVENTOR(S) : Robert H. Schneider

It is certified that error appears in the above-identified patent and that said Letters Patent is hereby corrected as shown below:

Col. 1, line 5, Delete "require" and substitute therefor ---regulate---

Col. 1, line 20, Delete "form" and substitute therefor ---from---

Col. 3, line 38, Delete "18" and substitute therefor ---38---

Col. 4, line 5, Delete "exists" and substitute therefor ---exits---

Claim 5, col. 8, line 61, Delete "portion sof" and substitute therefor ---portions of---

Claim 5, col. 8, line 62, Delete "ressitance" and substitute therefor ---resistance---

Claim 6, col. 8, line 65, Delete "loaed" and substitute therefor ---loaded---

Signed and Sealed this

Second Day of August, 1988

*Attest:*

*Attesting Officer*

DONALD J. QUIGG

*Commissioner of Patents and Trademarks*